US006399498B1

(12) United States Patent
Masumura et al.

(10) Patent No.: US 6,399,498 B1
(45) Date of Patent: Jun. 4, 2002

(54) METHOD AND APPARATUS FOR POLISHING WORK

(75) Inventors: Hisashi Masumura, Fukushima-ken; Fumio Suzuki, Fukshima-ken; Kouichi Okamura, Niigata-ken, all of (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/244,697

(22) Filed: Feb. 4, 1999

(30) Foreign Application Priority Data

Feb. 5, 1998 (JP) ..... 10-041311

(51) Int. Cl.[7] ..... H01L 21/302
(52) U.S. Cl. ..... 438/690; 438/691; 438/692
(58) Field of Search ..... 438/691, 692, 438/690

(56) References Cited

U.S. PATENT DOCUMENTS 4,132,037 A * 1/1979 Bonora ..... 51/131
5,605,487 A * 2/1997 Hileman et al. ..... 451/5
5,618,227 A * 4/1997 Tsutsumi et al. ..... 451/288
5,910,041 A * 6/1999 Duescher ..... 451/28

FOREIGN PATENT DOCUMENTS

JP 58180026 10/1983 ..... H01L/21/304
JP 63318260 12/1988 ..... B24B/37/04
JP 4242929 8/1992 ..... H01L/21/304

* cited by examiner

*Primary Examiner*—Benjamin L. Utech
*Assistant Examiner*—Vanessa Perez-Ramos
(74) *Attorney, Agent, or Firm*—Hogan & Hartson, L.L.P.

(57) ABSTRACT

There is disclosed a method of processing a work comprising polishing a work holding surface 4*a* of a work holding plate 4 by contacting and rubbing a work holding surface 4*a* of a work holding plate 4 with a polishing pad 2 attached on a polishing turn table 1 with providing polishing agent 5 thereto, holding a wafer W on said work holding surface 4*a* by vacuum-holding, and contacting and rubbing the wafer W with said polishing pad 2 to polish the work with providing polishing agent 5 wherein temperature of the polishing agent 5 or the polishing turn table 1 is controlled by temperature controller 7,9 so that a temperature of said work holding surface 4*a* when polishing said work holding plate 4 and a temperature of said work holding surface 4*a* when polishing the wafer w are controlled to be the same. Degradation of flatness due to thermal influence when polishing the holding plate and polishing the wafer can be prevented in a method of processing comprising polishing the work holding surface of the work holding plate to conform with the deformed shape of the polishing pad, holding a work with the work holding surface, and polishing the work.

8 Claims, 4 Drawing Sheets

(A)

(B)

METHOD AND APPARATUS FOR POLISHING WORK

BACKGROUND OF THE INVENTION

1. Field of the Invention

The present invention relates to a technique for polishing, for example, one side of a semiconductor wafer.

2. Description of the Related Art

As a conventional apparatus for polishing one side of a work such as a semiconductor wafer, there is known an apparatus equipped with a work holding plate made of metal, ceramics, glass or the like attached to a rotary holder which can be rotated, and a polishing pad attached on a polishing turn table which can be rotated. One side of the work is held on a work holding surface of the work holding plate, and the other side of the work is contacted and rubbed with the polishing pad with providing polishing agent to the surface which is contacted and rubbed, and thereby a surface of a work is polished.

As a method for holding the work on the work holding surface, a method of holding a work by fixing it directly on the surface using, for example, adhesive, wax or the like, a method of vacuum-holding using porous ceramics or the like are known. A technique of forming a resin layer on the work holding surface is also known, as disclosed in, for example Japanese Patent Publication No. 63-4937.

A polishing pad having viscoelastic properties is deformed during polishing. In order to correct degradation of flatness due to the deformation and improve flatness of a work, especially a thin work such as a wafer, Japanese Patent Application Laid-open (kokai) No. 63-318260 proposes a method comprising deforming the polishing pad using a dummy work so as to be in the same condition as the condition when polishing a work to be treated, thereafter polishing the work holding surface of the work holding plate with the deformed polishing pad so as to conform with the shape of the deformed polishing pad, namely, co-rubbing polishing (hereinafter referred to as "work holding surface optimization polishing"), then holding one side of the work with the work holding surface subjected to work holding surface optimization polishing, and subsequently polishing the other side of the work.

There are also known a method of increasing polishing load of a dummy work to accelerate deforming rate of a polishing pad in order to efficiently polish a work holding surface to be subjected to work holding surface optimization polishing as disclosed in Japanese Patent Application Laid-open (kokai) No. 4-242929, and a method of previously forming an acrylic resin layer or a polycarbonate resin layer on the work holding surface of the work holding plate, and subjecting the resin layer to work holding surface optimization polishing. Using the resin layer enables work holding surface optimization polishing can be conducted in short time, and the back side of the work can be protected.

Work holding surface optimization polishing disclosed in Japanese Patent Application Laid-open (kokai) No. 63-318260 is considered to be effective technique for flattening process. However, if the temperature of the work holding surface when polishing work holding plate directly is different from the temperature of the work holding surface when polishing the work, it causes degradation of flatness.

Namely, heat generated at a polishing portion makes difference between the temperature of the work holding surface on the top side of the plate and the temperature of the surface on the back side of the plate, which causes deformation of the work holding plate. When the temperature of heat generated during work holding surface optimization polishing and the temperature of heat generated during polishing the work are different, the deformation amount of the work holding plate due to heat generated during work holding surface optimization polishing will be different from the deformation amount of the work holding plate due to heat generated during polishing the work, and it causes degradation of flatness.

In the technique wherein a resin layer is formed on a work holding surface, when an acrylic resin is used, a processing speed of work holding surface optimization polishing can be accelerated so that processing time therefor can be shortened. However, because of low rigidity, when the resin layer which is adhered on the holding plate is polished to be too thin, non-uniformity of adhesion is caused, which is undesirable by reason that, for example, the non-uniformity of adhesion is transferred to the processing surface of the work held thereon.

On the other hand, if the resin layer is too thick, rigidity of the work holding surface will be insufficient, which may cause problems such as unstable flatness on processing the work, generation of a crack in the resin layer due to the difference of the thermal expansion coefficient of the resin and the holding plate, and the like.

When polycarbonate is used for the resin layer, as it has higher rigidity than an acrylic resin, it does not cause a problem of degradation of flatness due to insufficient rigidity or the like. However, friction resistance in work holding surface optimization polishing will be large, load on the polishing apparatus will be high, and therefore stable polishing will be difficult.

Moreover, when polycarbonate is used, processing speed will be low, resulting in longer processing time, larger heat release amount, which causes a problem that a deformation degree of the work holding plate due to heat is unstable.

SUMMARY OF THE INVENTION

The present invention has been accomplished to solve the above-mentioned problems, and an object of the present invention is to achieve stable work flatness by eliminating difference of thermal effect when conducting work holding surface optimization polishing and when polishing a work, and give a good influence on work flatness by using an appropriate material for a resin layer formed on the work holding surface in a method of processing comprising subjecting the work holding surface of the work holding plate to work holding surface optimization polishing to conform with the deformed shape of a polishing pad, holding a work with the work holding surface subjected to work holding surface optimization polishing, and polishing the work.

To achieve the above object, the present invention provides a method of polishing a work comprising polishing a work holding surface by contacting and rubbing a work holding plate with a polishing pad (work holding surface optimization polishing), holding a back surface of the work on said work holding surface of said work holding plate, and thereafter contacting and rubbing the work with said polishing pad to polish the front surface of the work characterized in that a temperature of said work holding surface of said work holding plate when polishing said work holding surface (work holding surface optimization polishing) and a temperature of said work holding surface of said work holding plate when polishing the work are controlled to be the same.

According to the above method, degradation of flatness can be prevented by controlling the temperature when conducting work holding surface optimization polishing and the temperature when polishing a work to be the same to eliminate the difference of the deformation amount of the work holding plate due to heat generated during work holding surface optimization polishing and during polishing the work.

In an embodiment of the present invention, the temperature of said work holding surface can be controlled by controlling a temperature of polishing agent provided during polishing, or by controlling a temperature of a polishing turn table holding the polishing pad, or by controlling both of them.

The temperature of the work holding surface when conducting work holding surface optimization polishing and temperature of the work holding surface when polishing the work are controlled to be the same by controlling a temperature of polishing agent and/or a polishing turn table holding the polishing pad as described above.

The temperature of the polishing agent and the polishing turn table can be controlled using a temperature controller provided in at least one of a polishing agent supplying system and a polishing turn table. The temperature of the polishing turn table can be controlled easily by, for example, controlling temperature of cooling water for cooling the polishing turn table.

Control of the temperature can be conducted either by controlling the temperature when conducting work holding surface optimization polishing to be the same as the temperature when polishing the work, or by controlling the temperature when polishing the work to be the same as the temperature when conducting work holding surface optimization polishing. It can also be conducted by controlling both of them to be a certain temperature.

In an embodiment of the present invention, a resin layer may be formed on the work holding surface of the work holding plate, and pores for vacuum-holding may be formed in the resin layer and the work holding plate.

When the resin layer is formed on the work holding surface as described above, the processing when conducting work holding surface optimization polishing can be conducted easily, dirt on the back side of the work is hardly adhered on the work holding surface so that stable processing accuracy can be achieved, and furthermore, the back side of the work can be held softly so that the work can be protected well.

The resin layer can be formed by adhesion of the resin plate or resin coating by any other method.

In an embodiment of the present invention, the resin layer is formed of ABS resin or epoxy resin.

ABS (acrylonitrile butadiene styrene copolymer) resin and epoxy resin are excellent in workability, processing time for work holding surface optimization polishing will be short, and heat release amount during work holding surface optimization polishing will be stable so that the temperature can be controlled accurately and easily. Moreover, the resins show relatively high rigidity when holding the work so that the work can be polished in high accuracy.

In an embodiment of the present invention, thickness of the resin layer may be in the range of 1 to 5 mm.

When the resin layer is formed in the range of thickness, work flatness can be improved.

Namely, thickness less than 1 mm may lead to the problem that non-uniformity of adhesion is transferred to the processing surface of the work held thereon. Thickness more than 5 mm may lead to lower rigidity for holding the work, resulting in unstable work flatness.

As explained above, according to the present invention, a temperature of the work holding surface when work holding surface optimization polishing and a temperature of the work holding surface when polishing the work are controlled to be the same in the method of polishing the work comprising subjecting a work holding plate to work holding surface optimization polishing, holding the work on the work holding surface thereof, and contacting and rubbing the work with the polishing pad for polishing, and thus the difference of the deformation amount of the work holding plate due to heat is eliminated so that flatness of the work can be improved.

In the method, when the temperature of said work holding surface is controlled by controlling a temperature of polishing agent, or by controlling a temperature of a polishing turn table holding the polishing pad, or controlling both of them, and a temperature controller is provided in at least one of the polishing agent supplying system and the polishing turn table, control of the temperature can be conducted easily.

When a resin layer is formed on the work holding surface, the processing when conducting work holding surface optimization polishing can be conducted easily, dirt on the back side of the work is hardly adhered on the work holding surface so that stable processing accuracy can be achieved, and furthermore, the back side of the work can be held softly so that the work can be protected well.

When the resin layer is formed of the predetermined resin, work holding surface optimization polishing can be conducted in short time as the resins are excellent in workability. Moreover, when the resin is used, heat release amount generated during work holding surface optimization polishing will be stable so that temperature can be controlled accurately and easily. Moreover, the resins show relatively high rigidity when holding the work so that the work can be polished in high accuracy.

When thickness of the resin layer is in the predetermined range, work flatness can be further improved.

DESCRIPTION OF THE INVENTION AND A PREFERRED EMBODIMENT

The present invention will be further described below in detail with reference to the attached drawings.

First, outline of general work holding surface optimization polishing process will be explained referring to FIG. 6, before the method of polishing a work of the present invention will be explained.

Figure 6:
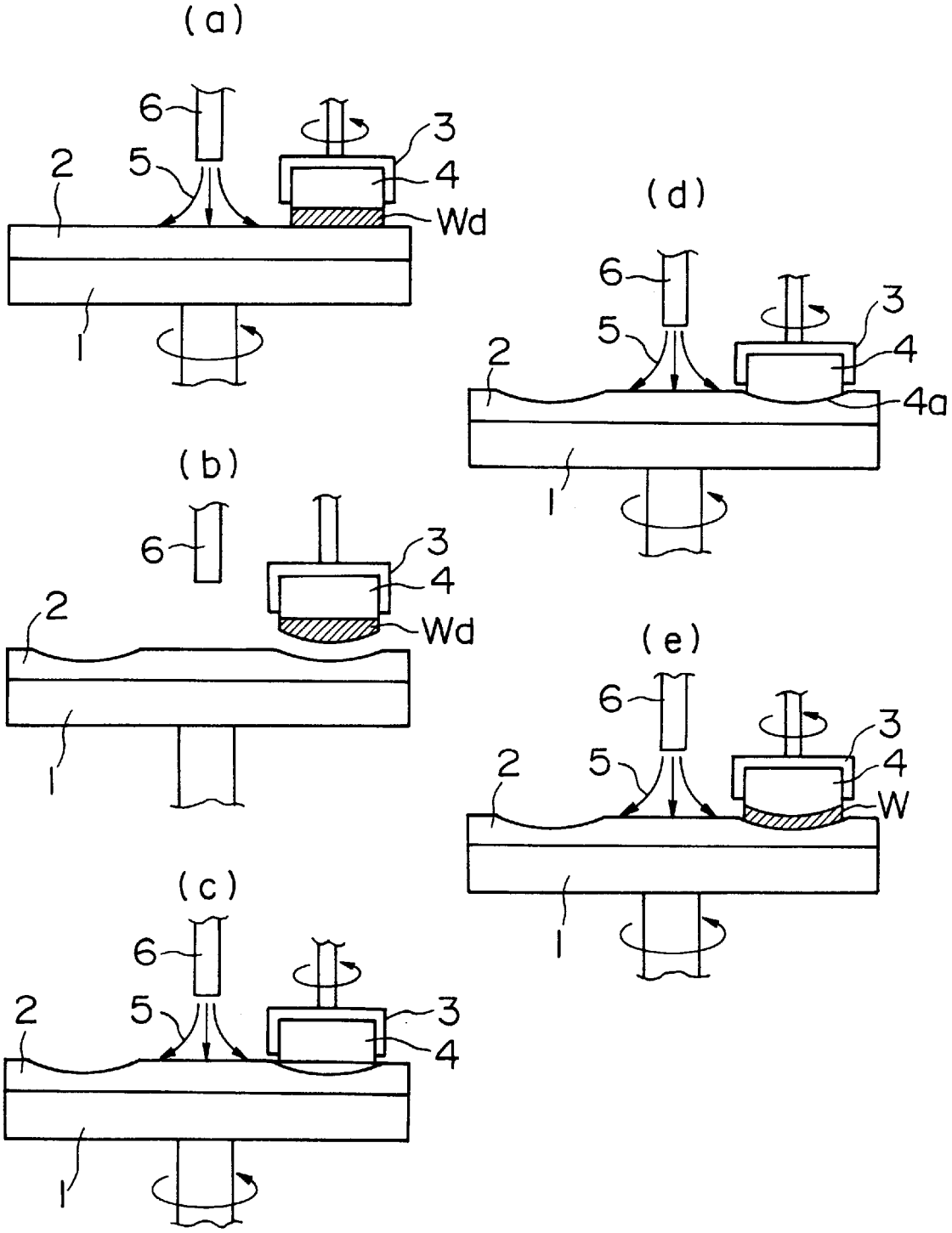
FIGS. 6(*a*)–(*e*) are explanatory view showing a general work holding surface optimization polishing process.

As shown in FIG. 6(*a*), a polishing pad 2 is attached on a polishing turn table 1 that can be rotated. A work holding plate 4 is attached to the rotary holder 3 located on the opposite side of the polishing turn table 1. A nozzle 6 for supply of polishing agent 5 is located near the center portion of the polishing turn table 1.

A dummy wafer Wd is held by the work holding plate 4 to conduct control of the surface shape of the polishing pad 2.

Namely, while the polishing turn table 1 and the rotary holder 3 are rotated, the dummy wafer Wd is contacted and rubbed with the polishing pad 2, with supplying the polishing agent 5 from the nozzle 6. The surface of the polishing pad 2 is thereby deformed in the same shape as the shape when the wafer is polished.

After control of the surface shape of the polishing pad 2 with the dummy wafer Wd is completed, the dummy wafer Wd is removed, and the work holding plate 4 is pressed against the polishing pad 2, the contact surface of the work holding plate 4 is subjected to work holding surface optimization polishing with supplying the polishing agent 5 in the similar way to the above-mentioned method as shown in FIG. 6(*c*) to form the work holding surface 4*a* conforming with the shape of the polishing pad 2 as shown in FIG. 6(*d*).

The wafer W is held on the work holding surface 4*a*, and polished in the similar way to the above method as shown in FIG. 6(*e*). The wafer is thereby polished in a constant thickness, and in high flatness.

Figure 1:
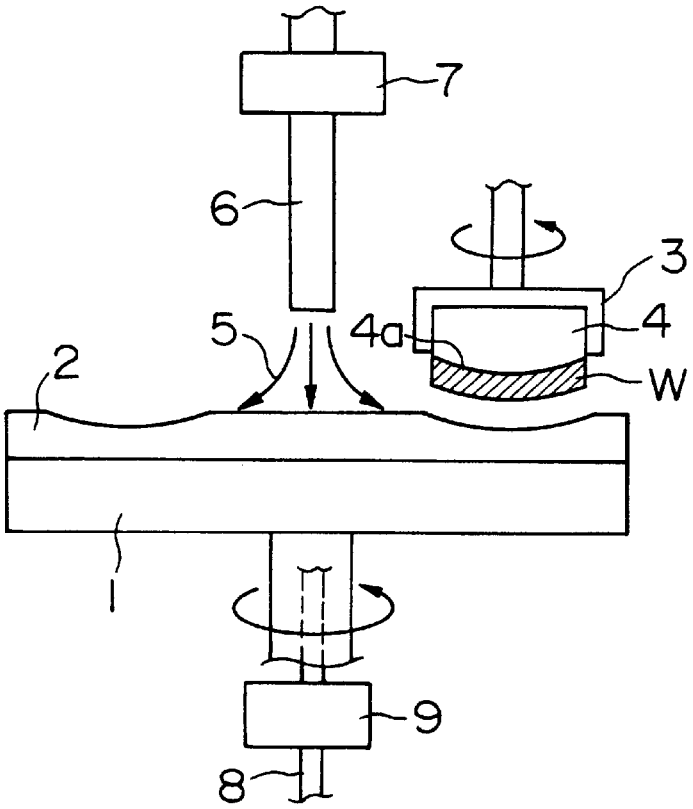
FIG. 1 is a schematic view showing an apparatus for polishing of the present invention.

In the polishing method as described above, in accordance with the present invention, temperature of the work holding surface 4*a* when conducting work holding surface optimization polishing of the work holding plate 4 and the temperature of the work holding surface 4*a* when polishing the wafer W are controlled to be the same, to achieve high flatness of the wafer as shown in FIG. 1. Control of the temperature is carried out by providing a temperature controller 7 for controlling the temperature of the polishing agent 5 in the supply system of the polishing agent 5, or by providing a temperature controller 9 for controlling the temperature of cooling water in the cooling water supply system 8 for supplying cooling water to the polishing turn table 1, or by using both of them.

Using the temperature controllers 7,9, the temperature of the work holding surface 4*a* when polishing, for example, the wafer W is controlled to be the same as the temperature of the work holding surface 4*a* when conducting work holding surface optimization polishing the work holding plate 4 so that the shape of the work holding surface 4*a* formed in work holding surface optimization polishing can be the same as the shape of the wafer W formed in polishing.

It is also possible to control the temperature of the work holding surface 4*a* when conducting work holding surface optimization polishing to be the same as the temperature of the work holding surface 4*a* when polishing the wafer W, or to control to be a certain temperature both of the temperature when conducting work holding surface optimization polishing and the temperature when polishing of the wafer.

In that case, a method for measuring the temperature of the work holding surface 4*a* is not limited to a specific method. It can be directly measured by burying thermocouple in the work holding plate 4. Alternatively, it can be indirectly measured by measuring the temperature of the polishing pad 2 or the like with a radiation thermometer and the like. In this embodiment, it was measured by both methods.

Figure 3:
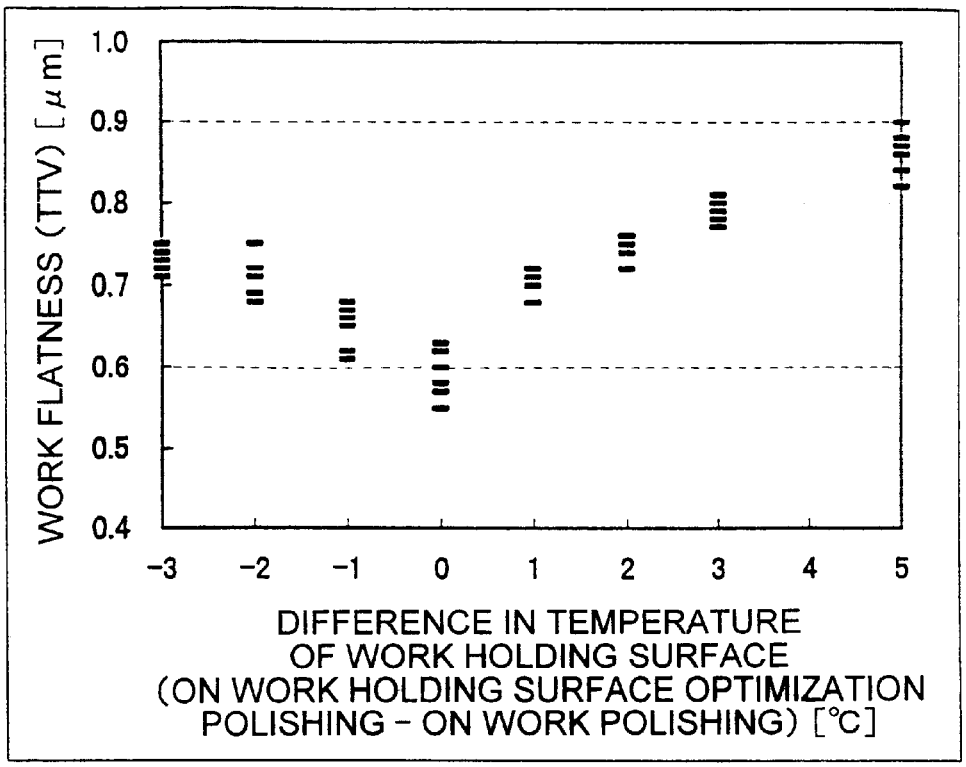
FIG. 3 is a graph showing a relation between the difference in temperature of a work holding surface when conducting work holding surface optimization polishing and when polishing a work and work flatness.

FIG. 3 shows results of a measurement that was conducted to see the influence on flatness of the wafer caused by the difference between the temperature of the work holding surface 4*a* when conducting work holding surface optimization polishing of the work holding plate and the temperature of the work holding surface 4*a* when polishing the wafer W.

In the measurement, the temperature when conducting work holding surface optimization polishing and the temperature when polishing the work were controlled so that the difference thereof is in the range of from −3° C. to 5° C. and at interval of 1° C., and work flatness when polishing the work was measured.

In the measurement, the p-type monocrystal silicon wafer grown by Czochralski method having a thickness of 735 $\mu$m, a <100> crystal orientation, and a diameter of 200 mm, etched wafer was used as a work. A nonwoven fabric polishing pad having a hardness of 80 (Asker C hardness; a value measured with a spring type hardness tester type C in accordance with JIS K6301) was used as the polishing pad, and colloidal silica abrasive of pH=10.5 was used as the polishing agent. Polishing was conducted at polishing load of 250 g/cm$^2$, to the stock removal of 12 $\mu$m.

From the result, it was confirmed that the best flatness TTV (Total Thickness Variation) can be achieved when the temperature difference is 0° C., and larger difference of temperature results in inferior flatness. Therefore, it is confirmed the method of the present invention wherein temperature is controlled so as to eliminate temperature difference is effective.

Namely, when the temperature of the work holding surface 4*a* when conducting work holding surface optimization polishing is 3° C. higher than the temperature of the work holding surface 4*a* when polishing the wafer, cooling water in the polishing turn table 1 when conducting work holding surface optimization polishing is controlled to be 3° C. lower, or the temperature of the polishing agent 5 when polishing the wafer W is controlled to be 3° C. higher.

Next, it will be explained below that work flatness is further improved by forming a resin layer of ABS resin or epoxy resin on the work holding surface 4*a* in the method of the present invention.

Figure 2:
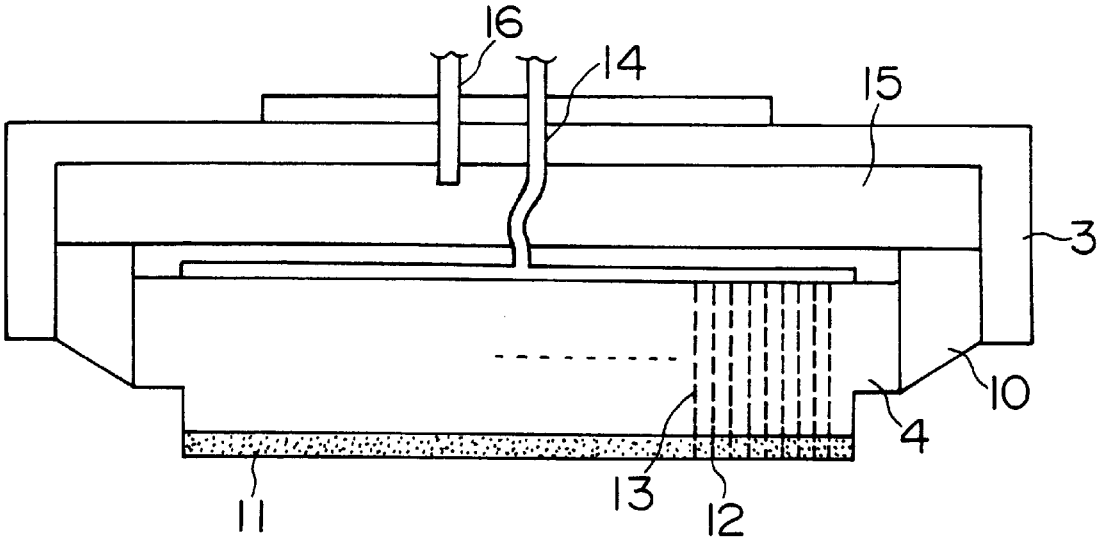
FIG. 2 is an enlarged view of a work holding plate before work holding surface optimization polishing.

As shown in FIG. 2, the work holding plate 4 is hung on rotary holder 3 via an elastic ring 10. The elastic ring 10 also serves to keep air tightness of space 15 between the rotary holder 3 and the work holding plate 4. In the space 15, fluid such as air can be introduced through an inlet pipe 16 to press the work holding plate 4 elastically.

On the surface of the work holding plate 4, the resin layer 11 of ABS resin or epoxy resin is formed. The resin layer 11 can be formed by adhesion of the resin plate or resin coating by any other method. The resin layer 11 has a thickness of 1 to 5 mm.

On the surface of the resin layer 11, a lot of fine vacuum pores 12 having a diameter of about 0.5±0.1 mm are formed. The vacuum pores 12 communicate with a vacuum pathway 13 formed in a certain pattern on the work holding plate 4. The vacuum pathway 13 communicates with a vacuum pathway 14 of the rotary holder 3.

Accordingly, the wafer W can be held by vacuuming via the vacuum pathway 13 with a vacuum pump or the like, and released by stopping vacuuming.

Figure 4:
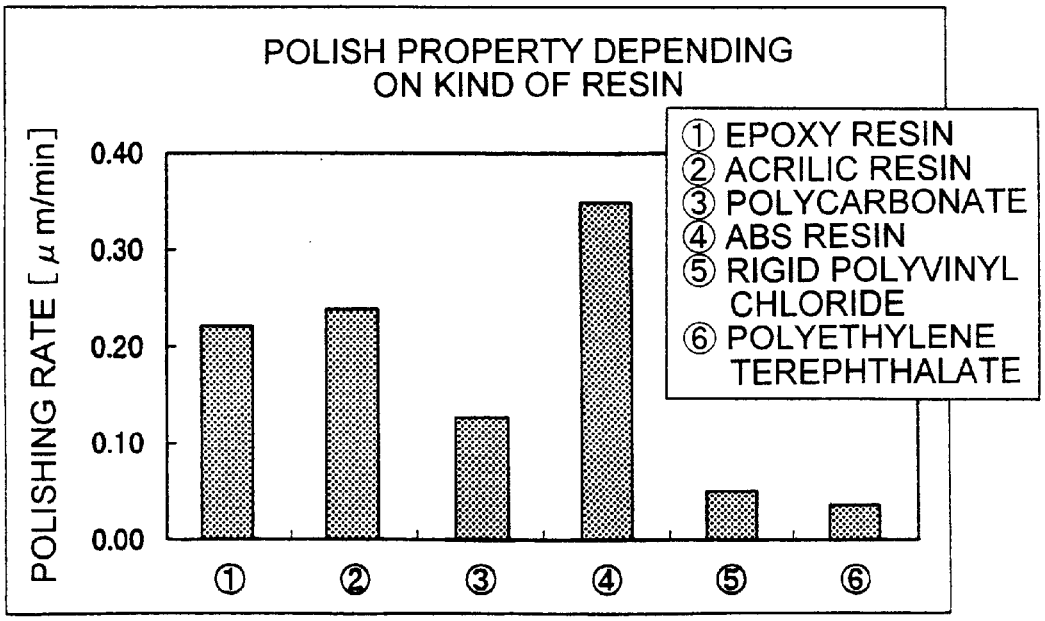
FIG. 4 is a graph showing polishing characteristics depending on kinds of resin.

Since the resin layer 11 is formed on the work holding plate 4, the work holding surface 4*a* is formed by polishing the resin layer 11 by work holding surface optimization polishing. The reason of why ABS resin and epoxy resin are selected for material of the resin layer 11 is as follows:

FIG. 4 is a graph showing a polishing rate ($\mu$m/min) when conducting work holding surface optimization polishing using several kinds of resins. Polishing is conducted using nonwoven fabric polishing pad having a hardness of 80 (Asker C hardness) as a polishing pad, colloidal silica of pH=10.5 as a polishing agent under polishing load of 300 g/cm$^2$. Rigid polyvinyl chloride ⑤ and polyethylene terephthalate ⑥ could hardly be polished under the above-mentioned condition. Polycarbonate ③ could not be polished well.

When polishing the resin material as the above-mentioned material which cannot be polished well, longer polishing time is required, and therefore, the wafer will be affected more by an heat release amount, and flatness will be unstable. The results shown in FIG. 5 also supports the fact that longer polishing time may lead to in unstable flatness.

Figure 5:
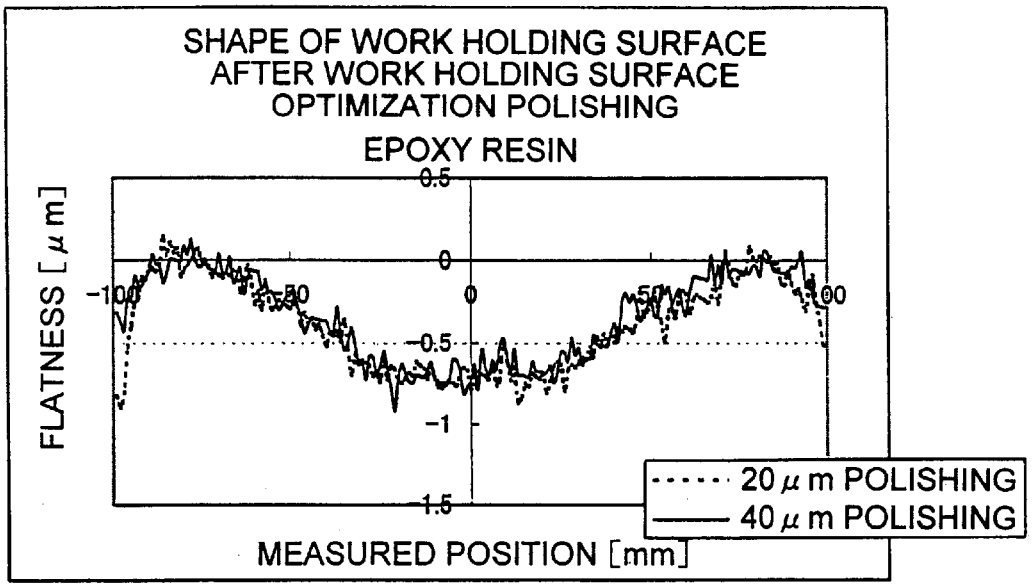
FIG. 5 is an explanatory view showing a shape of a work holding surface after work holding surface optimization polishing. (A) shows the case that epoxy resin is used, (B) shows the case that polycarbonate resin is used.
Figure 5:
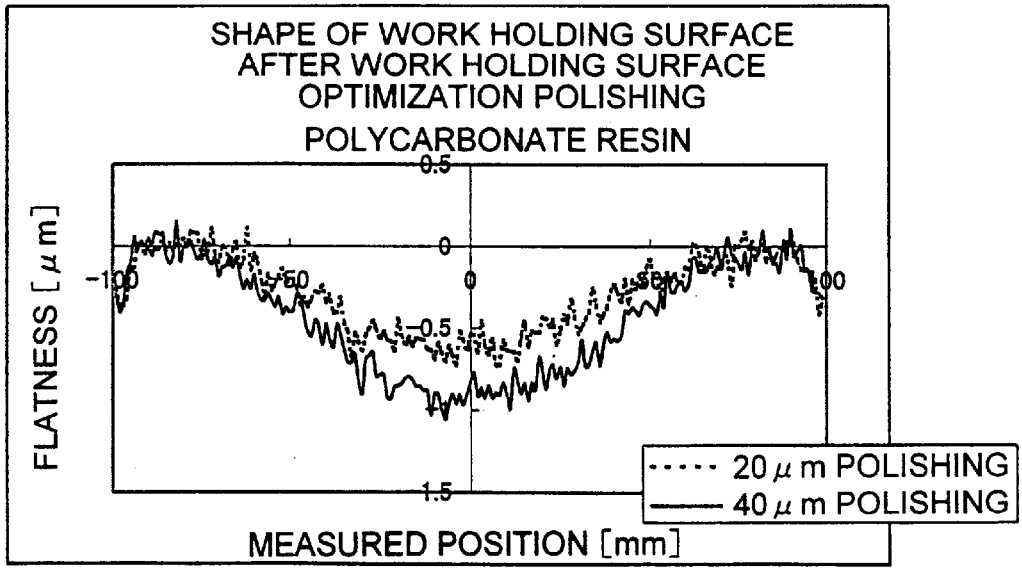

FIG. 5 shows the shape of the work holding surface 4*a* after the resin layer 11 of epoxy resin (FIG. 5(A)) and the resin layer 11 of polycarbonate resin (FIG. 5(B)) are subjected to work holding surface optimization polishing to the stock removal of 20 $\mu$m and 40 $\mu$m. When using epoxy resin, there is little difference whether polishing is conducted to the stock removal 20 $\mu$m or 40 $\mu$m. When using polycarbonate resin, there is difference in the shape whether the stock removal is 20 $\mu$m or 40 $\mu$m.

The reason is inferred as follows. Epoxy resin and polycarbonate resin are different in a polishing rate as shown in FIG. 4. Accordingly, it is clear that polycarbonate resin requires more polishing time when polishing in the stock removal of 20 $\mu$m or 40 $\mu$m, and is more affected by heat generated during polishing, which may lead to unstable flatness.

Moreover, the unstable shape of the work holding surface 4*a* results in more degradation of flatness of the wafer W.

Epoxy resin ①, acrylic resin ② and ABS resin ④ are more excellent in polish ability as shown in FIG. 4. However, because of low rigidity, when the resin layer of acrylic resin is polished to be too thin, non-uniformity of adhesion is caused when the resin layer 11 is adhered on the holding plate 4, which is undesirable by the reason that the non-uniformity of adhesion is transferred to the polishing surface of the wafer W held thereon.

On the other hand, when thickness of the resin 11 of acrylic resin is too thick, rigidity of the work holding surface 4*a* will be insufficient, which may lead to problems such as unstable flatness when polishing the wafer W, and the like.

By the above-mentioned reasons, ABS resin or epoxy resin are used for the resin layer 11 in the present invention.

The reason of why the thickness is in the range of from 1 to 5 mm is as follows. When the thickness is less than 1 mm, non-uniformity of adhesion of the resin layer 11 is transferred on the polished surface of the wafer W held by vacuum-holding. When the thickness is more than 5 mm, flatness of the wafer W is lowered due to lowering of rigidity.

As described above, when the resin layer 11 consisting of ABS resin or epoxy resin is formed on the work holding surface 4*a* in proper thickness, the wafer W is held by vacuum-holding, and a temperature of the work holding surface 4*a* when conducting work holding surface optimization polishing and a temperature of the work holding surface 4*a* when polishing the work are controlled to be the same, high flatness will be achieved by polishing.

The present invention is not limited to the above-described embodiment. The above-described embodiment is a mere example, and those having the substantially same structure as that described in the appended claims and providing the similar action and effects are included in the scope of the present invention.

For example, the work is not limited to a silicon wafer. Any kinds of polishing agent 5 and any kinds of polishing pad 2 can be used.

Moreover, temperature controller 7, 9 for controlling temperature of the polishing agent 5 and the polishing turn table 1 is mere example. Any types of work holding plate 4, any types of rotary holder 3 and work holding plate can be used, and any method for holding the work can be used. Namely, any methods generally used can be applied for the present invention.

What is claimed is:

1. A method of polishing a work comprising polishing a work holding surface by contacting and rubbing a work holding plate with a polishing pad, holding a back surface of the work on said work holding surface of said work holding plate, thereafter contacting and rubbing the work with said polishing pad to polish the front surface of the work, and employing at least one temperature controller to control the temperature of said work holding surface of said work holding plate when polishing said work holding surface and the temperature of said work holding surface of said work holding plate when polishing the work to be the same.

2. The method of polishing the work according to claim 1 wherein the temperature of said work holding surface is controlled by controlling the temperature of a polishing agent provided during polishing, or by controlling the temperature of a polishing turn table holding the polishing pad, or by controlling both of them.

3. The method of polishing the work according to claim 1 wherein a resin layer is formed on the work holding surface of the work holding plate, and pores for vacuum-holding are formed in the resin layer and said work holding plate.

4. The method of polishing the work according to claim 2 wherein a resin layer is formed on the work holding surface of the work holding plate, and pores for vacuum-holding are formed in the resin layer and said work holding plate.

5. The method of polishing the work according to claim 3 wherein said resin layer is formed of ABS resin or epoxy resin.

6. The method of polishing the work according to claim 4 wherein said resin layer is formed of ABS resin or epoxy resin.

7. The method of polishing the work according to claim 5 wherein thickness of the resin layer is in the range of 1 to 5 mm.

8. The method of polishing the work according to claim 6 wherein thickness of the resin layer is in the range of 1 to 5 mm.

* * * * *